US008103026B2

(12) United States Patent
Wu et al.

(10) Patent No.: US 8,103,026 B2
(45) Date of Patent: Jan. 24, 2012

(54) MICROPHONE MODULE WITH ELECTROMAGNETIC INTERFERENCE SHIELDING MEANS

(75) Inventors: Li-Te Wu, Taipei (TW); Yan-Li Lin, Taipei County (TW)

(73) Assignee: Fortemedia, Inc., Sunnyvale, CA (US)

( * ) Notice: Subject to any disclaimer, the term of this patent is extended or adjusted under 35 U.S.C. 154(b) by 1062 days.

(21) Appl. No.: 11/964,091

(22) Filed: Dec. 26, 2007

(65) Prior Publication Data

US 2009/0169033 A1 Jul. 2, 2009

(51) Int. Cl.
*H04R 25/00* (2006.01)

(52) U.S. Cl. ..... 381/174; 381/189

(58) Field of Classification Search ..... 381/174, 381/175, 189, 322, 323, 324, 355, 361, 150; 257/414, 415, 416, 417, 418, 419, 420
See application file for complete search history.

(56) References Cited

U.S. PATENT DOCUMENTS

| | | | | |
|---|---|---|---|---|
| 4,424,419 | A | 1/1984 | Chaput et al. | |
| 2006/0262946 | A1 | 11/2006 | Yang | |
| 2007/0127762 | A1 | 6/2007 | Zhang | |
| 2008/0144874 | A1 * | 6/2008 | Wu et al. | 381/355 |

* cited by examiner

*Primary Examiner* — Ha Tran T Nguyen
*Assistant Examiner* — Kevin Quinto
(74) *Attorney, Agent, or Firm* — Thomas|Kayden

(57) ABSTRACT

A microphone module includes a cabinet, a sensor, an integrated circuit chip, a first substrate, and a second substrate. The first substrate carries the integrated circuit chip and includes a first top surface, a first bottom surface, and a first shielding part with a fixed electric potential extending from the first top surface to the first bottom surface. The second substrate includes a second top surface contacting the first bottom surface, a second bottom surface, and a second shielding part with the fixed electric potential on the second bottom surface, wherein the second shielding part is arranged in such a way that no electromagnetic waves can pass between the first shielding part and the second shielding part.

12 Claims, 12 Drawing Sheets

MICROPHONE MODULE WITH ELECTROMAGNETIC INTERFERENCE SHIELDING MEANS

BACKGROUND OF THE INVENTION

1. Field of the Invention

The invention relates to a microphone module with electromagnetic interference (EMI) shielding means.

2. Description of the Prior Art

Referring to FIGS. 1A, 1B, and 1C, a conventional condenser microphone module 100 comprises a metal cabinet 110, a diaphragm 120, a plastic ring 130, a back plate 140, a conduction ring 142, and a substrate 150. The metal cabinet 110, closed at bottom by the substrate 150, accommodates the diaphragm 120, the plastic ring 130, the back plate 140, and the conduction ring 142. The diaphragm 120 and the back plate 140, spaced apart by the plastic ring 130, are permanently electrically charged to implement a capacitor sensor 160. Incoming sound waves enter via an acoustic opening 111 of the metal cabinet 110 and are translated into mechanical vibrations upon contacting the diaphragm 120. The mechanical vibrations are converted into an electrical signal that varies in voltage amplitude and frequency corresponding to the original sound waves. The substrate 150 generally is a circuit board with an integrated circuit chip 151 mounted thereon. The integrated circuit chip 151 receives and amplifies the electrical signal and provides an output signal.

The substrate (i.e. circuit board) 150 has a top surface 157 with the integrated circuit chip 151 mounted thereon, and a bottom surface 158 from which a plurality of pins 152, 154, 155, and 156 protruding. FIG. 2A depicts the top surface 157 of the substrate 150, wherein the shaded regions indicate a plurality of electrically conductive parts 1501, 1502, 1503, and 1504, and a shielding part 1505. FIG. 2B depicts the bottom surface 158 of the substrate 150, obtained by turning the substrate 150 in accordance with the arrow A of FIG. 2A. Except for the electrically conductive part 1501, the other electrically conductive parts 1502, 1503, and 1504, and the shielding part 1505 penetrate through the substrate 150 from the top surface 157 to the bottom surface 158.

The plurality of pins protruding from the bottom surface 158 of the substrate 150 respectively are a data pin 152, a power pin 154, a ground pin 155, and a clock pin 156. In operation, an external power source (not shown) provides the integrated circuit chip 151 with power through the power pin 154 on the bottom surface 158 and the electrically conductive part 1502 extending from the bottom surface 158 to the top surface 157. The integrated circuit chip 151 receives an electrical signal from the capacitor sensor 160 through the conduction ring 142 and the electrically conductive part 1501 on the top surface 157, receives a clock signal from external circuitry (not shown) through the clock pin 156 on the bottom surface 158 and the electrically conductive part 1503 extending from the bottom surface 158 to the top surface 157, and sends out a data signal through the electrically conductive part 1504 extending from the top surface 157 to the bottom surface 158 and the data pin 152 on the bottom surface 158.

The metal cabinet 110 is grounded and serves as an electromagnetic interference (EMI) shielding means for protecting the capacitor sensor 160 and the integrated circuit chip 151 from EMI. However, external electromagnetic waves may penetrate through the substrate 150 affecting the capacitor sensor 160 and the integrated circuit chip 151 in the condenser microphone 100. Specifically, the shielding part 1505 of the substrate 150 extending from the top surface 157 of FIG. 2A to the bottom surface 158 of FIG. 2B is grounded via the ground pin 155 and used for blocking the external electromagnetic waves. However, there is a gap not protected by the shielding part 1505, allowing electromagnetic waves to pass through. The gap is indicated by reference numeral 200 in FIG. 2C, which can be recognized when FIG. 2A is laid over FIG. 2B and both are observed simultaneously.

BRIEF SUMMARY OF THE INVENTION

The invention provides a microphone module with EMI shielding means. The microphone module in accordance with an exemplary embodiment of the invention includes a cabinet, a sensor, an integrated circuit chip, a first substrate, and a second substrate. The first substrate carries the integrated circuit chip and includes a first top surface, a first bottom surface, and a first shielding part with a fixed electric potential extending from the first top surface to the first bottom surface. The second substrate includes a second top surface contacting the first bottom surface, a second bottom surface, and a second shielding part with the fixed electric potential on the second bottom surface, wherein the second shielding part is arranged in such a way that no electromagnetic waves can pass between the first shielding part and the second shielding part.

In another exemplary embodiment, the second shielding part on the second bottom surface of the second substrate is disposed exactly under the sensor.

In another exemplary embodiment, the second shielding part on the second bottom surface of the second substrate is round.

In another exemplary embodiment, the second shielding part totally occupies the second bottom surface of the second substrate.

In another exemplary embodiment, the second shielding part on the second bottom surface of the second substrate is rectangular.

In another exemplary embodiment, the first shielding part and the second shielding part are grounded.

In another exemplary embodiment, the sensor is a capacitor sensor.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
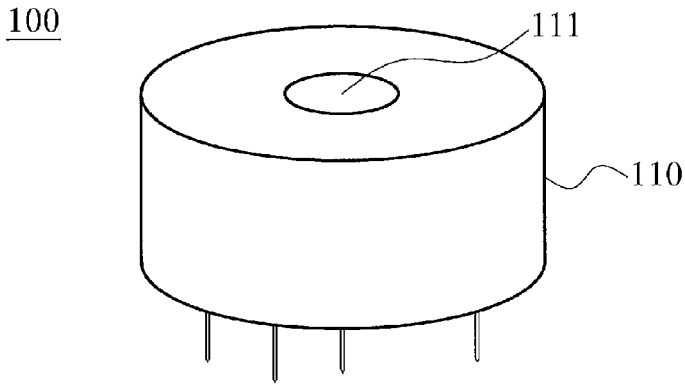
FIG. 1A (PRIOR ART)
FIG. 1A shows a conventional condenser microphone module.
Figure 1B:
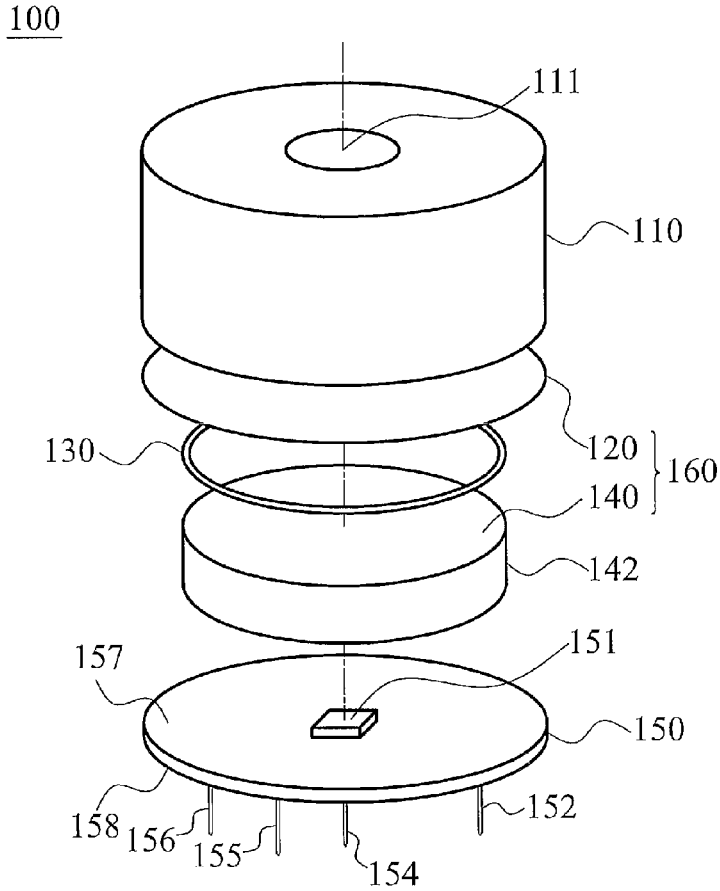
FIG. 1B (PRIOR ART)
FIG. 1B is a perspective exploded diagram of the conventional condenser microphone module of FIG. 1A.
Figure 1C:
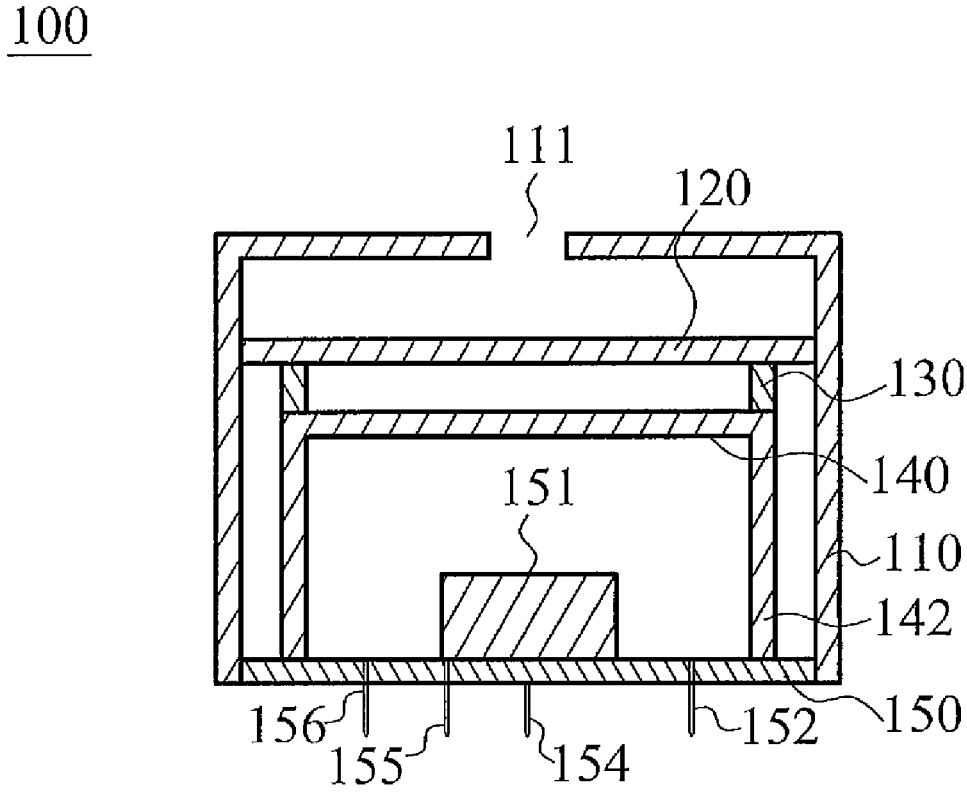
FIG. 1C (PRIOR ART)
FIG. 1C depicts a cross section of the conventional condenser microphone module of FIG. 1A.
Figure 2B:
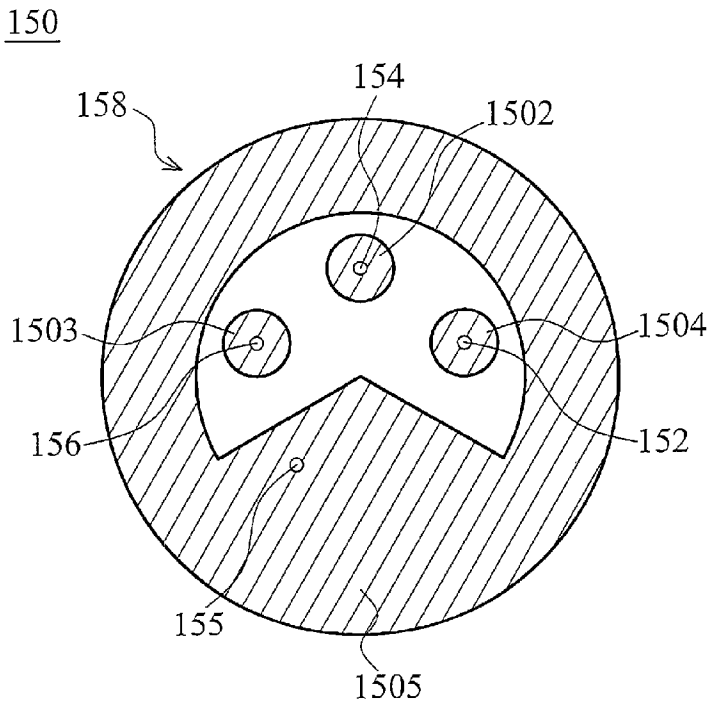
FIG. 2B (PRIOR ART)
FIG. 2B depicts the bottom surface of the substrate of the conventional condenser microphone module of FIG. 1A.
Figure 2A:
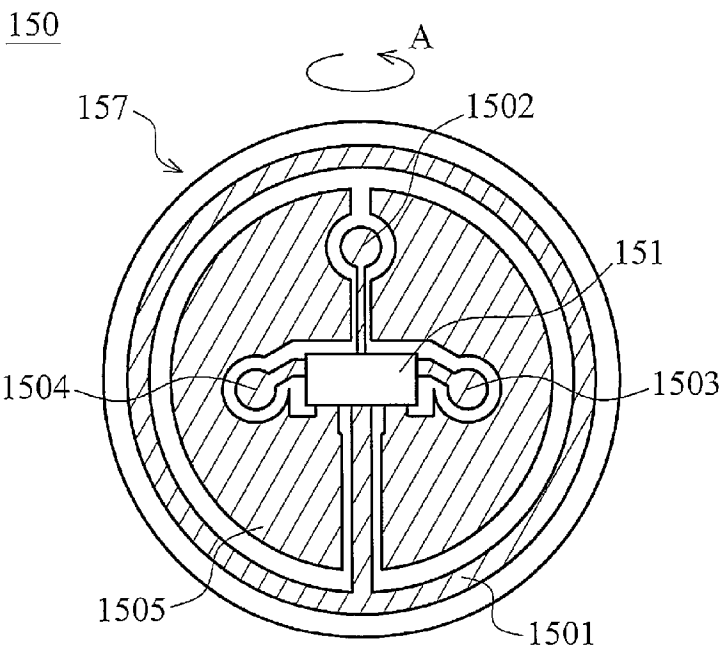
FIG. 2A (PRIOR ART)
FIG. 2A depicts the top surface of the substrate of the conventional condenser microphone module of FIG. 1A.
Figure 2C:
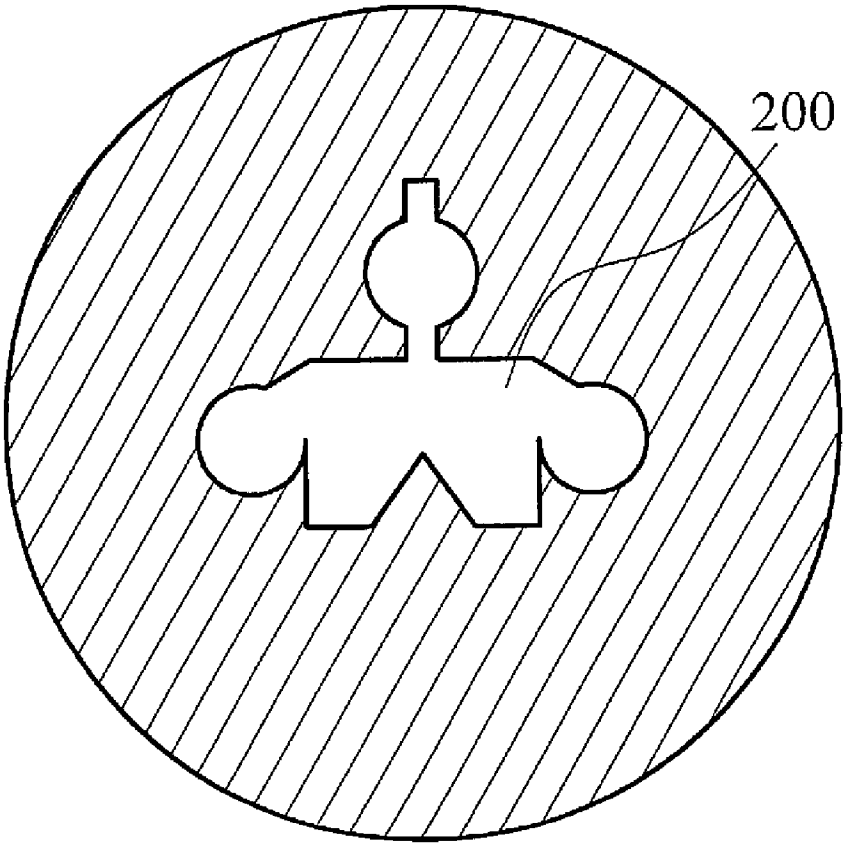
FIG. 2C (PRIOR ART)
FIG. 2C depicts a gap not protected by the shielding part of the substrate of the conventional condenser microphone module of FIG. 1A.
Figure 3A:
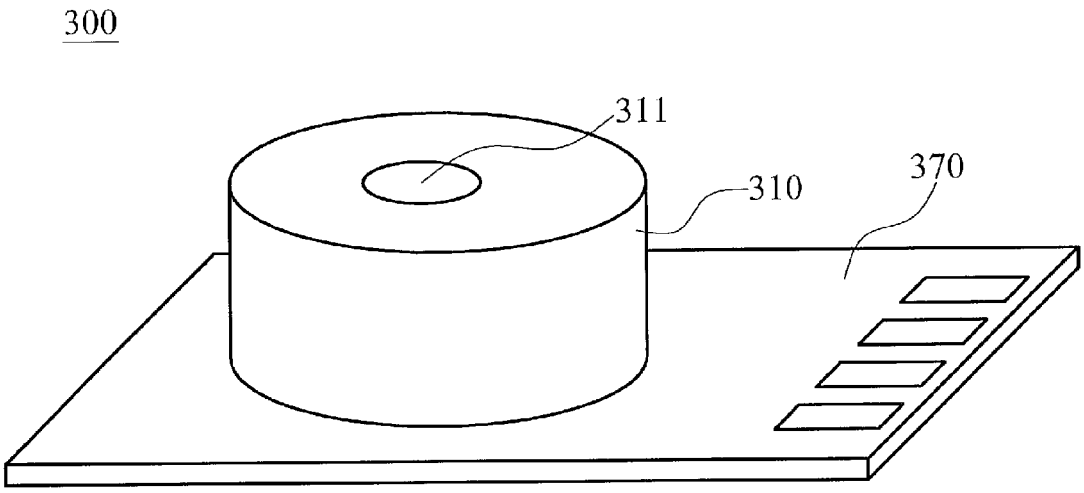
FIG. 3A shows a microphone module in accordance with an embodiment of the invention.
Figure 3B:
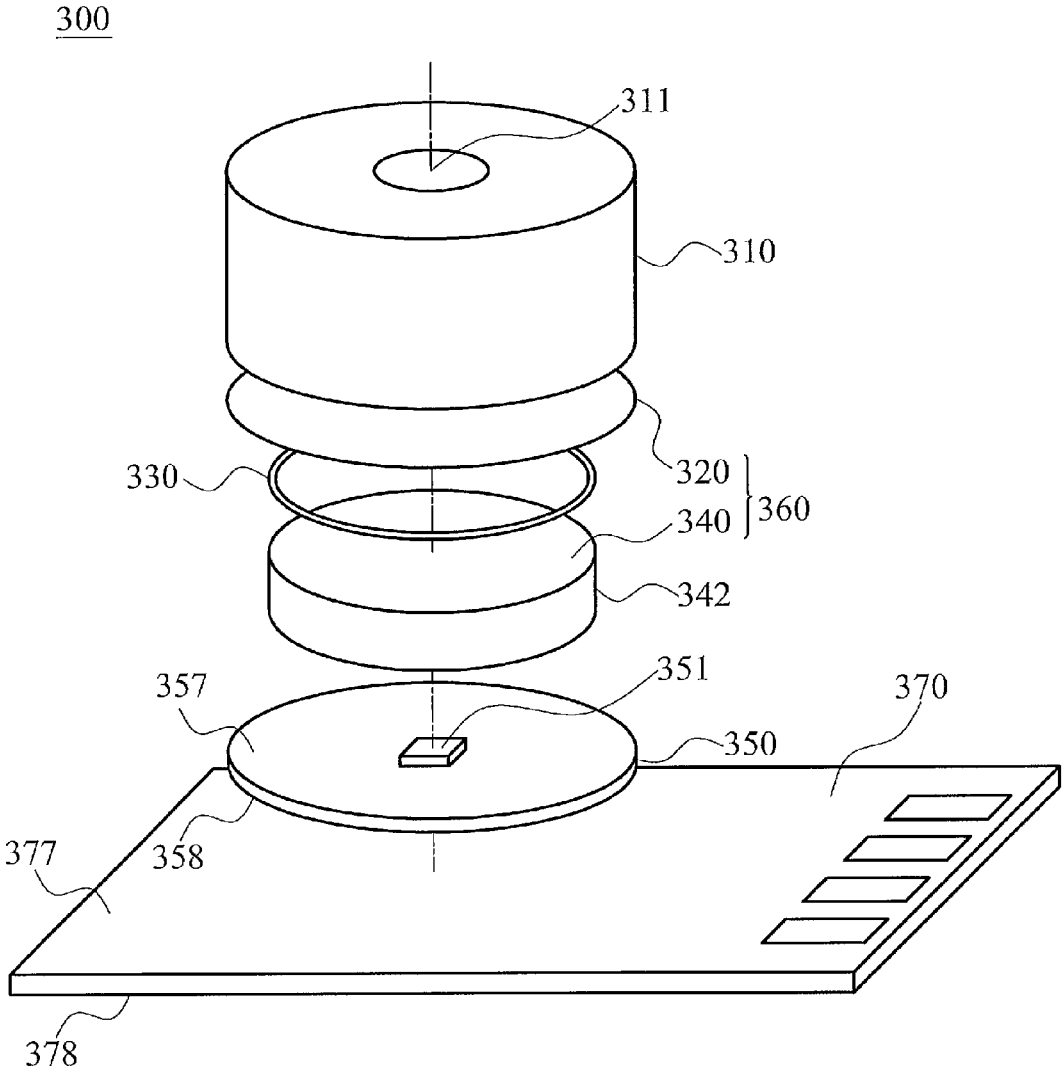
FIG. 3B is a perspective exploded diagram of the microphone module of FIG. 3A.
Figure 3C:
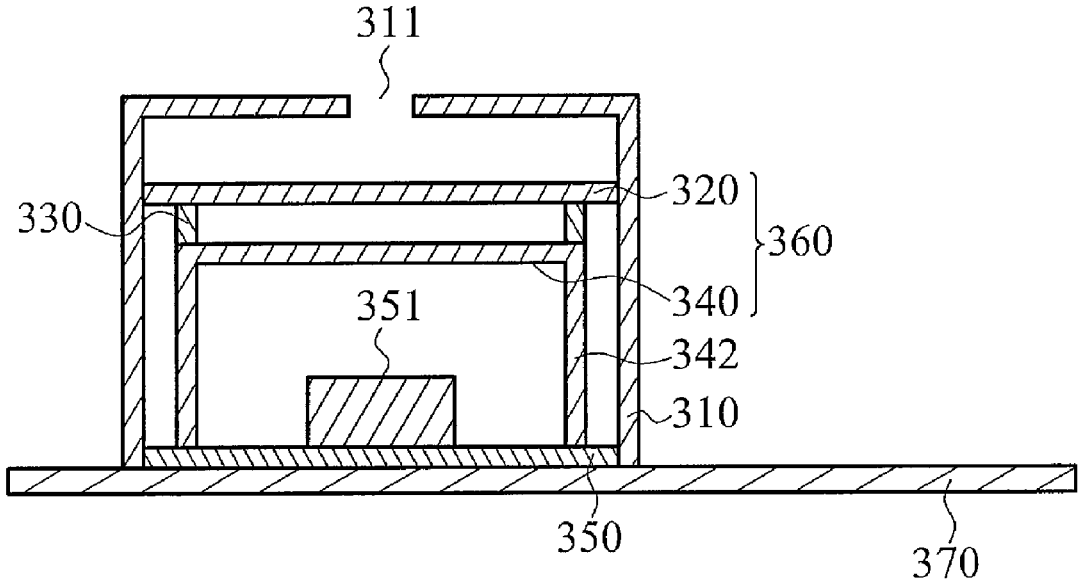
FIG. 3C depicts a cross section of the microphone module of FIG. 3A.

Referring to FIGS. 3A, 3B, and 3C, a microphone module 300 of an embodiment of the invention comprises a metal cabinet 310, a diaphragm 320, a plastic ring 330, a back plate 340, a conduction ring 342, a first substrate 350, and a second substrate 370. The metal cabinet 310 is closed at bottom by the first substrate 350 and the second substrate 370 to accommodate the diaphragm 320, the plastic ring 330, the back plate 340, and the conduction ring 342. The metal cabinet 310 and the second substrate 370 are capable of protecting the capacitor sensor 360 and the integrated circuit chip 351 from EMI, described in detail later.

The diaphragm 320 and the back plate 340, spaced apart by the plastic ring 330, are permanently electrically charged to implement a capacitor sensor 360. Incoming sound waves enter via an acoustic opening 311 of the metal cabinet 310 and are translated into mechanical vibrations upon contacting the diaphragm 320. The mechanical vibrations are converted into an electrical signal that varies in voltage amplitude and frequency corresponding to the original sound waves. In this embodiment, the first substrate 350 is a circuit board with an integrated circuit chip 351 mounted thereon. The integrated circuit chip 351 receives and amplifies the electrical signal and provides an output signal.

Figure 4B:
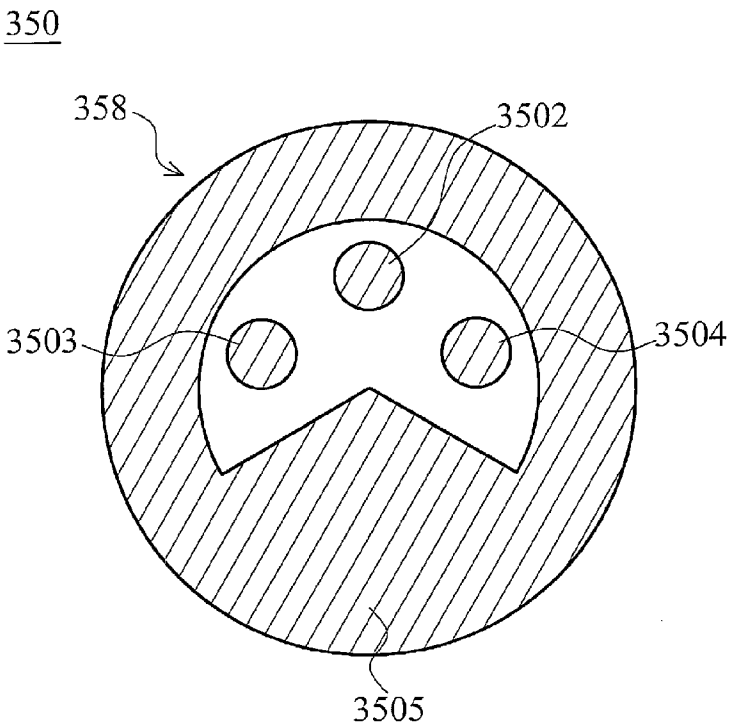
FIG. 4B depicts the first bottom surface of the first substrate of the microphone module of FIG. 3A.
Figure 4A:
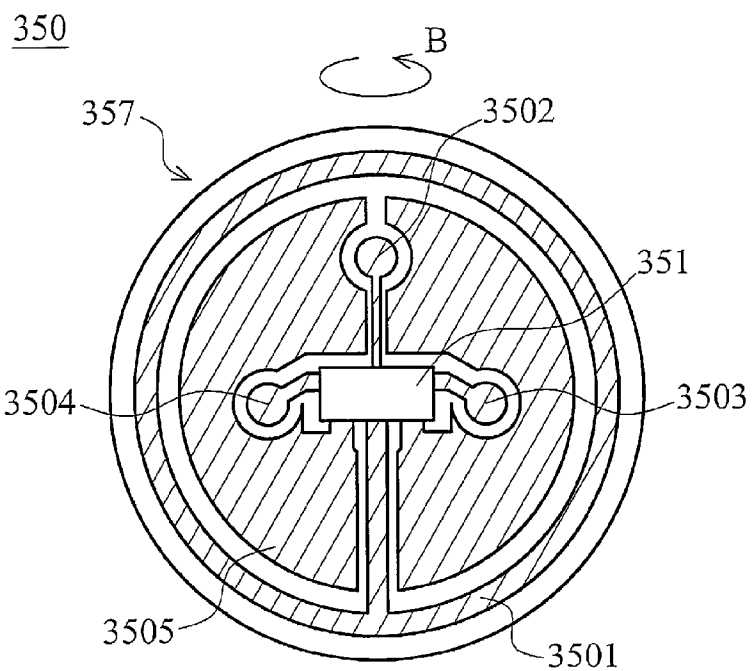
FIG. 4A depicts the first top surface of the first substrate of the microphone module of FIG. 3A.

The first substrate 350 has a first top surface 357 with the integrated circuit chip 351 mounted thereon, and a first bottom surface 358. FIG. 4A depicts the first top surface 357 of the first substrate 350, wherein the shaded regions indicate a plurality of electrically conductive parts 3501, 3502, 3503, and 3504, and a first shielding part 3505. FIG. 4B depicts the first bottom surface 358 of the first substrate 350, obtained by turning the first substrate 350 in accordance with the arrow B of FIG. 4A. Except for the electrically conductive part 3501, the other electrically conductive parts 3502, 3503, and 3504, and the first shielding part 3505 penetrate through the first substrate 350 from the first top surface 357 to the first bottom surface 358.

Figure 5A:
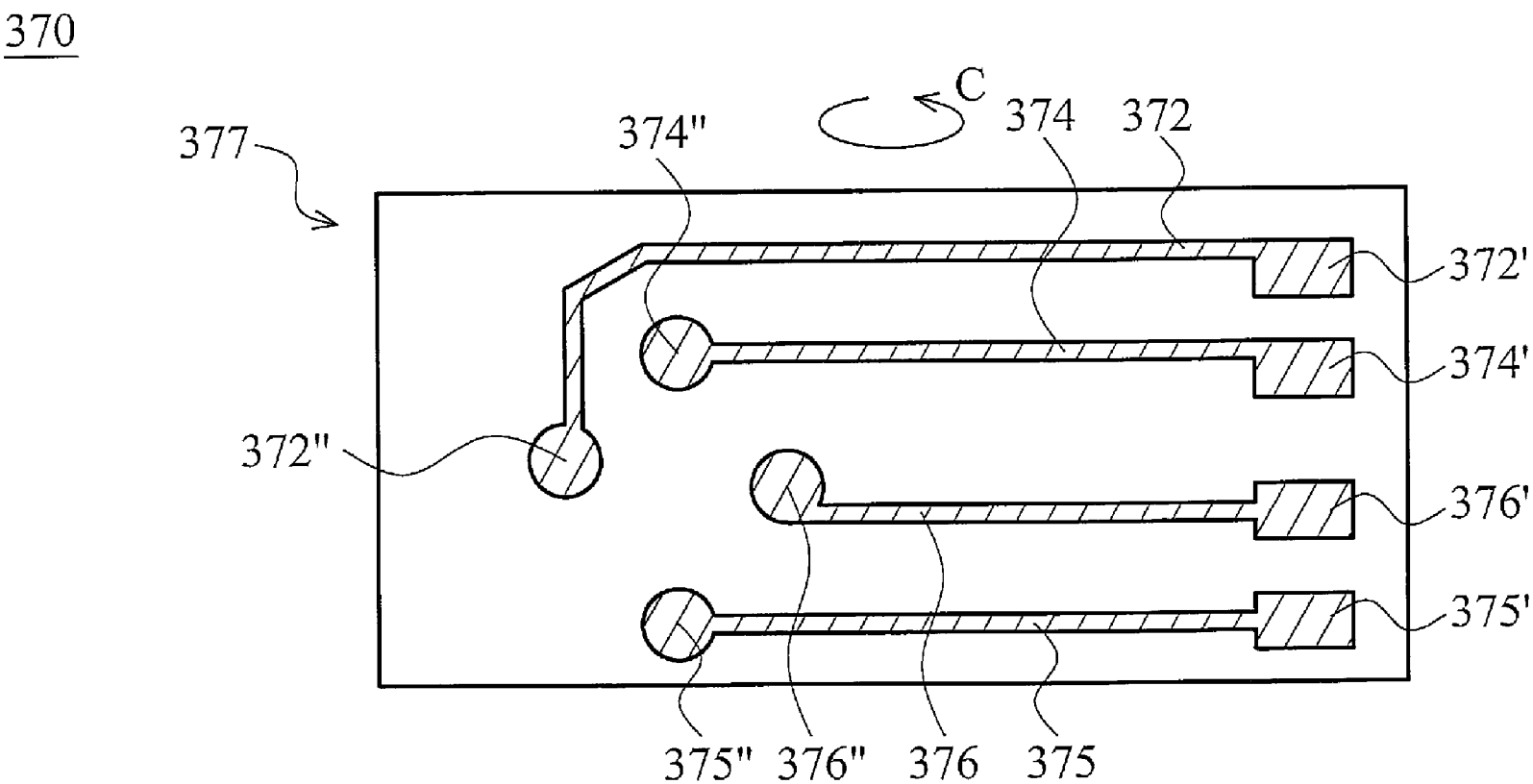
FIG. 5A depicts the second top surface of the second substrate of the microphone module of FIG. 3A.
Figure 5B:
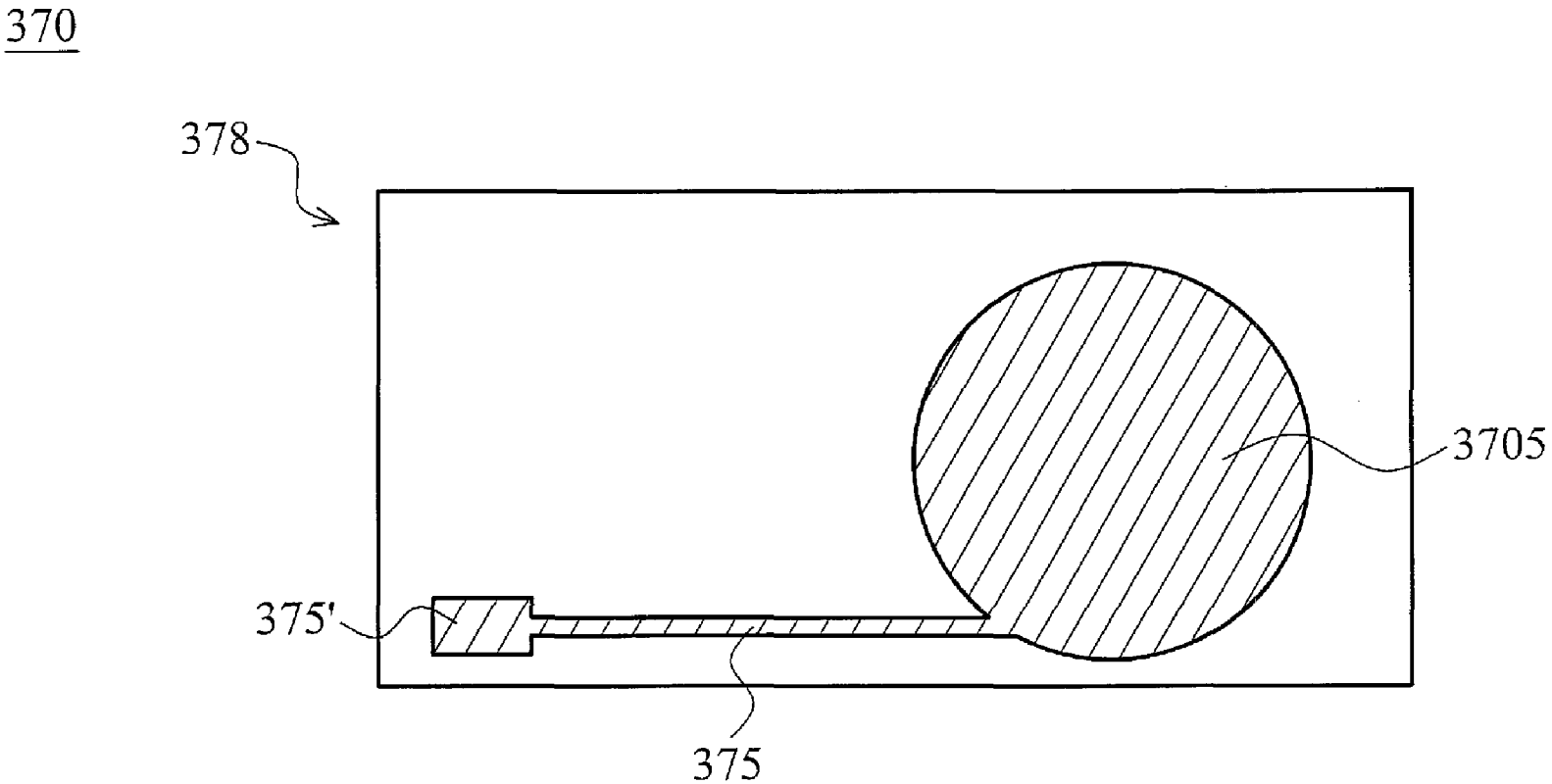
FIG. 5B depicts the second bottom surface of the second substrate of the microphone module of FIG. 3A.

The second substrate 370 has a second top surface 377 and a second bottom surface 378. FIG. 5A depicts the second top surface 377 of the second substrate 370, wherein the shaded regions indicate a plurality of electrically conductive parts 372, 374, 375, and 376. The electrically conductive part 372 has a data pad 372' at one end and an electrical contact 372" at the other end, wherein the electrical contact 372" contacts the electrically conductive part 3504 on the first bottom surface 358 of the first substrate 350. The electrically conductive part 374 has a power pad 374' at one end and an electrical contact 374" at the other end, wherein the electrical contact 374" contacts the electrically conductive part 3502 on the first bottom surface 358 of the first substrate 350. The electrically conductive part 376 has a clock pad 376' at one end and an electrical contact 376" at the other end, wherein the electrical contact 376" contacts the electrically conductive part 3503 on the first bottom surface 358 of the first substrate 350. The electrically conductive part 375 has a ground pad 375' at one end and an electrical contact 375" at the other end, wherein the electrical contact 375" contacts the first shielding part 3505 on the first bottom surface 358 of the first substrate 350. Furthermore, the electrically conductive part 375 penetrates through the second substrate 370 from the second top surface 377 to the second bottom surface 378. FIG. 5B depicts the second bottom surface 378 of the second substrate 370, obtained by turning the second substrate 370 in accordance with the arrow C of FIG. 5A. The electrically conductive part 375 extends from the ground pad 375' to a second shielding part 3705 which is round and disposed exactly under the capacitor sensor 360.

In operation, an external power source (not shown) provides the integrated circuit chip 351 with power through the power pad 374', the electrically conductive part 374, and the electrical contact 374" of the second substrate 370, and the electrically conductive part 3502 of the first substrate 350 extending from the first bottom surface 358 to the first top surface 357. The integrated circuit chip 351 receives an electrical signal from the capacitor sensor 360 through the conduction ring 342 and the electrically conductive part 3501 on the first top surface 357 of the first substrate 350, receives a clock signal from external circuitry (not shown) through the clock pad 376', the electrically conductive part 376, and the electrical contact 376" of the second substrate 370, and the electrically conductive part 3503 of the first substrate 350 extending from the first bottom surface 358 to the first top surface 357, and sends out a data signal through the electrically conductive part 3504 of the first substrate 350 extending from the first top surface 357 to the first bottom surface 358, and the electrical contact 372", the electrically conductive part 372, and the data pad 372' of the second substrate 370.

Figure 6:
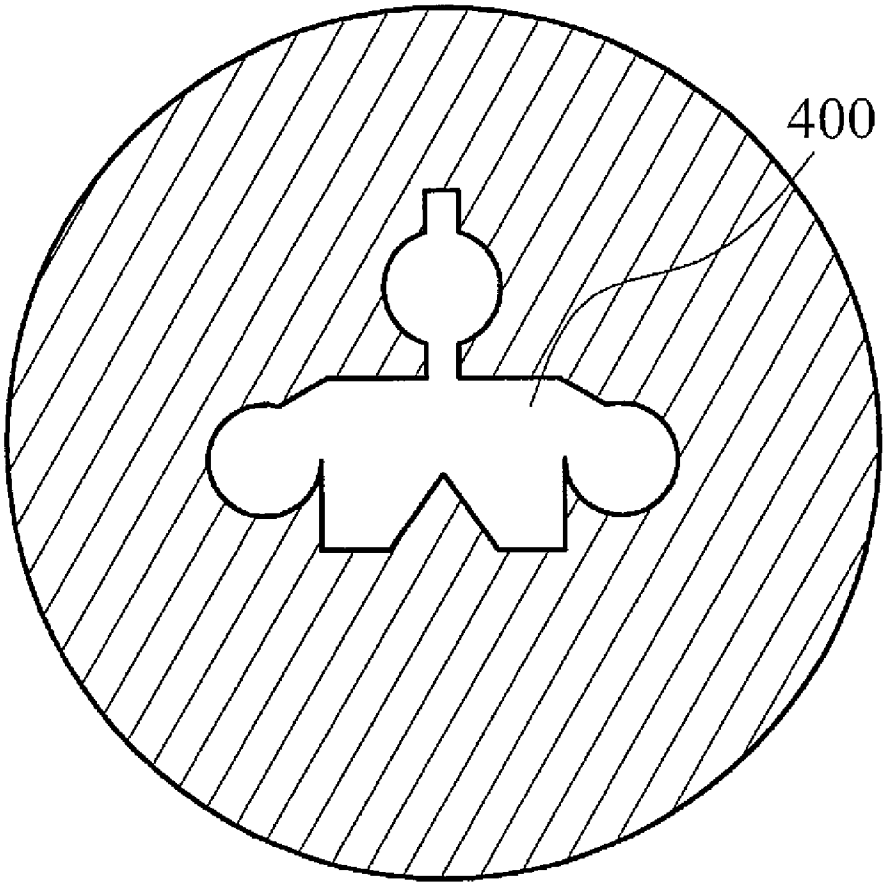
FIG. 6 depicts a gap not protected by the first shielding part of the first substrate of the microphone module of FIG. 3A.

The first shielding part 3505 of the first substrate 350 extending from the first top surface 357 of FIG. 4A to the first bottom surface 358 of FIG. 4B is grounded via the ground pad 375' of FIG. 5A for blocking the external electromagnetic waves. Referring to FIG. 6, there is a gap 400 not protected by the first shielding part 1505, which can be recognized when FIG. 4A is laid over FIG. 4B and both are observed simultaneously. The gap 400, however, is shielded by the second shielding part 3705 of the second substrate 370 of FIG. 5B. Thus, no electromagnetic waves can penetrate through the first and second substrates 350 and 370 (or pass between the first shielding part 3505 and the second shielding part 3705) to affect the capacitor sensor 360 and the integrated circuit chip 351 in the microphone module 300.

Figure 7:
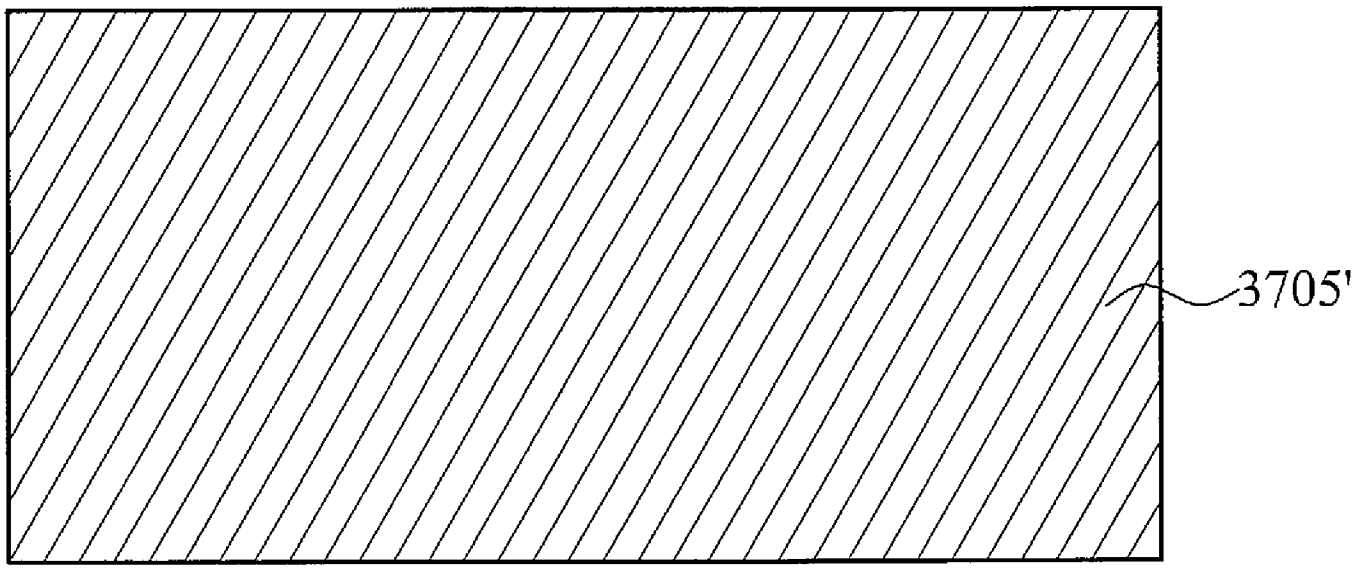
FIG. 7 depicts a modified second bottom surface of the second substrate of the microphone module of FIG. 3A.

In this embodiment, the second shielding part 3705 of the second substrate 370 is round and disposed exactly under the capacitor sensor 360. It is understood, however, that the second shielding part 3705 of the second substrate 370 can be in other shape for totally shielding the gap 400. As shown in FIG. 7, for example, the second shielding part 3705' is rectangular and totally occupies the second bottom surface of the second substrate 370.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone module, comprising:

a cabinet;

a sensor disposed in the cabinet;

an integrated circuit chip disposed in the cabinet;

a first substrate carrying the integrated circuit chip and including a first top surface, a first bottom surface, and a first shielding part with a fixed electric potential extending from the first top surface to the first bottom surface; and a second substrate including a second top surface contacting the first bottom surface, a second bottom surface, and a second shielding part with the fixed electric potential on the second bottom surface, wherein the second shielding part totally occupies the second bottom surface of the second substrate, and the second shielding part is arranged in such a way that no electromagnetic waves can pass between the first shielding part and the second shielding part.

2. The microphone module as claimed in claim 1, wherein the second shielding part on the second bottom surface of the second substrate is disposed exactly under the sensor.

3. The microphone module as claimed in claim 1, wherein the second shielding part on the second bottom surface of the second substrate is round.

4. The microphone module as claimed in claim 1, wherein the second shielding part on the second bottom surface of the second substrate is rectangular.

5. The microphone module as claimed in claim 1, wherein the first shielding part and the second shielding part are grounded.

6. The microphone module as claimed in claim 1, wherein the cabinet is grounded.

7. The microphone module as claimed in claim 1, wherein the sensor is a capacitor sensor.

8. A microphone module, comprising:

a cabinet;

a sensor disposed in the cabinet;

an integrated circuit chip disposed in the cabinet;

a first substrate carrying the integrated circuit chip and including a first top surface, a first bottom surface, and a first shielding part with a fixed electric potential extending from the first top surface to the first bottom surface; and a second substrate including a second top surface contacting the first bottom surface, a second bottom surface, and a second shielding part with the fixed electric potential on the second bottom surface, wherein the second shielding part on the second bottom surface of the second substrate is rectangular, and the second shielding part is arranged in such a way that no electromagnetic waves can pass between the first shielding part and the second shielding part.

9. The microphone module as claimed in claim 8, wherein the second shielding part on the second bottom surface of the second substrate is disposed exactly under the sensor.

10. The microphone module as claimed in claim 8, wherein the first shielding part on the second shielding part are grounded.

11. The microphone module as claimed in claim 8, wherein the cabinet is grounded.

12. The microphone module as claimed in claim 8, wherein the sensor is a capacitor sensor.

* * * * *